United States Patent [19]

Beyda et al.

[11] Patent Number: 4,709,954

[45] Date of Patent: Dec. 1, 1987

[54] HAND CARRYING DEVICE FOR GARMENT HANGERS

[76] Inventors: Marlee Beyda; Marilyn Beyda, both of 8537 Alcott St., Los Angeles, Calif. 90035

[21] Appl. No.: 885,304

[22] Filed: Jul. 14, 1986

[51] Int. Cl.[4] ..... A45C 13/26; A45F 5/10

[52] U.S. Cl. ..... 294/142; 294/165

[58] Field of Search ..... 294/137, 141–143, 294/145, 147, 149, 151–153, 156, 159, 162, 163, 165, 167, 170, 171; 223/98

[56] References Cited

U.S. PATENT DOCUMENTS

| | | | |
|---|---|---|---|
| 2,769,587 | 11/1956 | Threeton | 294/142 |
| 3,554,418 | 1/1971 | Holmes | 294/142 |
| 3,705,674 | 12/1972 | Fisher | 294/165 |
| 3,804,310 | 4/1974 | Wheeler | 294/142 |
| 3,885,723 | 5/1975 | Magnie | 294/142 |
| 3,961,734 | 6/1976 | Threeton | 294/143 |
| 4,288,012 | 9/1981 | Doak | 294/143 |
| 4,296,959 | 10/1981 | Helbig | 294/143 |

*Primary Examiner*—Johnny D. Cherry

*Attorney, Agent, or Firm*—Beehler, Pavitt, Siegemund, Jagger, Martella & Dawes

[57] ABSTRACT

A carrier for facilitating hand carrying of several garment hangers of the type having a hook for suspending the hanger from a horizontal rod or the like. The carrier includes a carrier body, a slot defined in the body for receiving a number of garment hanger hooks, carrying handle or flexible straps connected to the carrier body, and releasable retainers for closing the slot and prevent accidental withdrawal of hanger hooks from the slot, so that the hangers associated with the hooks can be conveniently carried together while suspended from the carrier body with or without garments hung therefrom.

14 Claims, 7 Drawing Figures

HAND CARRYING DEVICE FOR GARMENT HANGERS

BACKGROUND OF THE INVENTION

1. Field of the Invention

The invention pertains generally to the field of carrier devices designed to assist in hand carrying a plurality of separate items by interconnecting the same into a single bundle for easier hand carrying and transportation as a unit rather than a series of separate articles, and is more particularly directed to such a carrier device for holding together a number of conventional garment hangers with or without garments suspended therefrom so that all of the hangers and garments may be conveniently carried suspended from the common carrier.

2. State of the Prior Art

Garment hangers are available in a great variety of designs and materials of manufacture, including wire hangers such as are typically provided by dry cleaning and laundry establishments to their patrons; plastic covered wire hangers; molded plastic hangers in a wide assortment of designs; and a variety of wooden hangers ranging from a simple arched beam of unfinished wood and provided with a wire hook to elaborately constructed and finished hardwood coat hangers. A common element found in almost all such garment or coat hangers is an upwardly extending hook by which the hanger is suspended from a horizontal support such as a rod or length of tubing typically provided in closets for this purpose or in free-standing clothes racks such as found in department stores, check rooms of public establishments, etc. The hooks provided on the hangers, whether made of bent heavy gage rigid metallic wire, or of molded plastic, or of still other materials tend to be of substantially similar shape and dimensions. This is particularly true of the low cost wire hangers widely used by dry cleaning establishments, and which are also the more difficult and inconvenient type of hanger to carry because of the relatively thin and rather flexible wire used for these hangers which tend to cut into the flesh of the carrying hand particularly when several garment laden hangers are carried in one hand, and because of the unfinished, exposed, rather sharp end of the wire hook.

When picking up their dry cleaning, many persons thus have no convenient means for carrying the sometimes large bundles of clothing where each garment is suspended from a separate wire hanger. Such bundles frequently include six, ten or even more wire hangers which need to be carried from the store to the patron's vehicle, or sometimes longer distances on foot or by public conveyance. The task may be facilitated by tying together the hooks of the hangers by any expedient means available such as string, rubber bands or the like. Even so, the wire hooks tend to cut into and pinch the hand of the person carrying the bundle. Further, the bundle can be relatively heavy and bulky so that frequent shifting of the same from hand to hand is desirable, or at least repositioning of the hooks in relation to the carrying hand, yet the naked wire hooks are not easily maneuvered or shifted so as to maintain a reasonably comfortable hold on the bundle.

Therefore, what is needed is a simple, easy to use carrier adapted to receive the hooks of a number of garment hangers and having a more convenient handle or other means by which a person can grasp and carry the carrier with a number of garment hangers with garments suspended therefrom in one hand with greater ease and comfort. Such carrier should desirably be sufficiently inexpensive to manufacture so that it can be given away as a promotional item by dry cleaning establishments or department stores to their patrons but should also be sufficiently durable so that it can be reliably reused many times.

This applicant is not aware of an existing device which meets these needs.

BRIEF SUMMARY OF THE INVENTION

The present invention addresses the aforementioned needs by providing a novel carrier for conventional garment hangers of the type having a hook for suspending the hanger from a horizontal rod or the like. The carrier comprises a body or shell of preferably unitary construction having a longitudinal axis extending between two carrier body ends. A hook receiving slot is formed in the carrier body, the shape of the slot in a plane transverse to the carrier axis corresponding generally to the shape and size of the hooks on the garment hangers to be carried. The slot extends longitudinally through the carrier body so that a number of hooks can be inserted side by side into the slot through an open end of the slot at one end of the carrier body. The slot is preferably closed at an inner end but may if desired extend fully through the carrier and be open at both its ends. Each garment hanger hook is slid sideways into the carrier slot along the longitudinal axis of the carrier body, the hook being disposed in a plane transverse to the carrier axis. Thus, a number of garment hanger hooks may be inserted into the carrier in mutually adjacent relationship along the carrier axis within the slot. The carrier body is preferably provided with one or more carrying handles, which may be either integral with the carrier body or attached thereto. For example a carrying strap which may consist of a flexible loop can be connected to each end of the carrier body so that both loops can be grasped together in one hand for lifting the carrier with a load of garments suspended therefrom in the aforedescribed manner.

It is desirable to provide one or more retainer elements adapted to close the open end or ends of the carrier slot so as to retain the hanger hooks within the slot and prevent accidental disengagement and loss of hangers from the carrier. The presently preferred slot closing elements are flexible straps secured to the carrier body on one side of the slot opening and removably engageable, as by means of hook-and-loop type fasteners, at their opposite end to the carrier body on the other side of the slot, such that when closed each strap lies across the slot opening and prevents withdrawl of hooks from within the same.

The carrier body in a presently preferred embodiment has a longitudinal recess defined in its underside extending between the two ends of the body, allowing the carrier body to be seated on typical hanger rods of the type found in garment closets, so that the weight of garments suspended from the carrier is borne by the hanger rod while hangers are loaded into or unloaded from the carrier, thereby greatly facilitating and speeding the task.

The novel carrier device is further useful in combination with a garment bag for holding hangers in place within the garment bag. The carrier is removable from the garment bag for quickly packing or unpacking a load of clothing hung from hangers which in turn are suspended from the carrier here disclosed.

DETAILED DESCRIPTION OF THE PREFERRED EMBODIMENT

Figure 1:
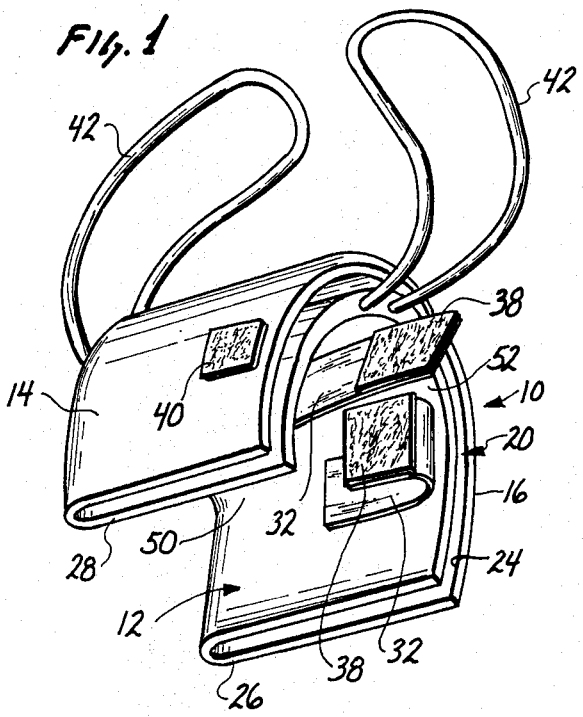
FIG. 1 is a perspective view of a garment hanger carrier according to present invention.
Figure 3:
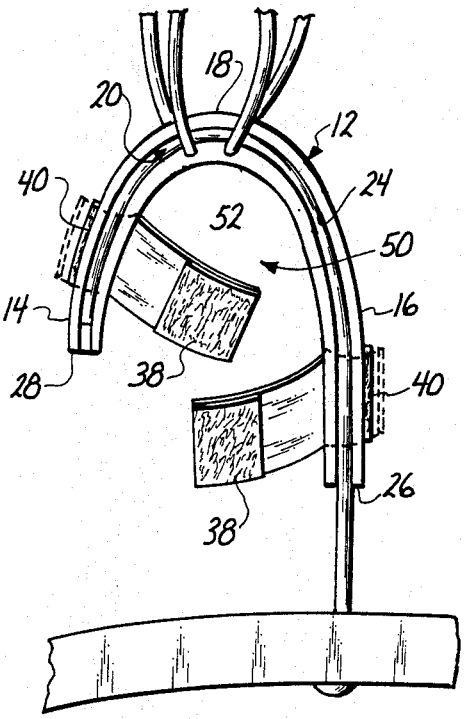
FIG. 3 is an end view taken along line 3—3 in FIG. 2.
Figure 2:
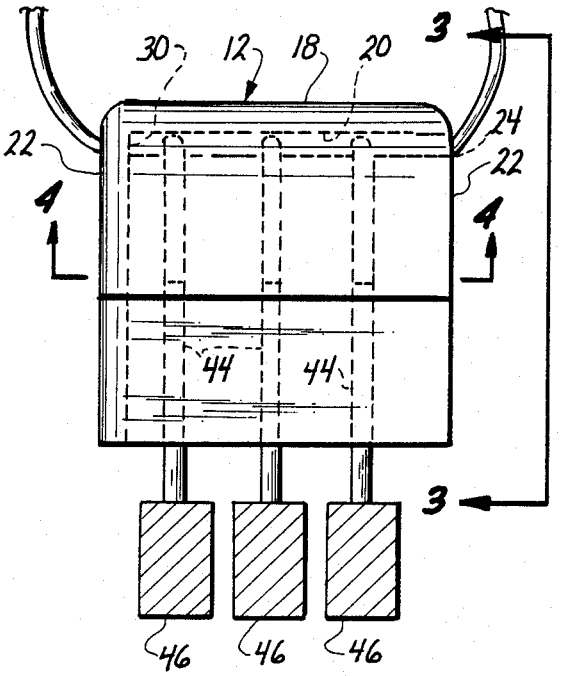
FIG. 2 is a side elevational view of the carrier of FIG. 1 showing a number of garment hangers suspended therefrom.

With reference to the drawings, FIG. 1 shows a presently preferred embodiment of the novel carrier 10 which is seen to comprise a carrier body or shell 12 which is generally shaped as an inverted U when seen in end view as in FIG. 3, one leg 14 of the U being shorter than the other leg 16 and having an upper curved intermediate portion 18 connecting the two legs. The carrier body extends longitudinally between two ends 22 as seen in FIG. 2 and remains substantially uniform in its cross-section between the two ends. A carrier slot 20 is defined in the carrier body 12, the slot 20 having an inverted U cross-sectional shape similar to that of the carrier body. The cross sectional shape of the slot 20 is thus hook shaped and dimensioned so as to accept the hooks of the garment hangers to be carried suspended from the carrier 10. The slot 20 has a slot end opening 24 at one of the carrier ends 22 through which slot opening the hanger hooks are inserted and removed, and is further open along the lower edge 26 of the longer carrier leg 16 as best seen in FIG. 1. The slot 20 may be also open along the lower edge 28 of the shorter carrier leg 14 so as to allow for hooks having a length greater than that of the shorter leg 14 in which case the hook ends will extend beyond the edge 28. The slot 20 extends longitudinally maintaining the aforedescribed inverted U cross-sectional shape through the carrier body 12 as best seen in FIG. 2 and terminates in a closed slot end or bottom 30. The carrier body can be advantageously molded in unitary form from low cost thermoplastic material, and thus manufactured inexpensively in quantity.

Figure 4:
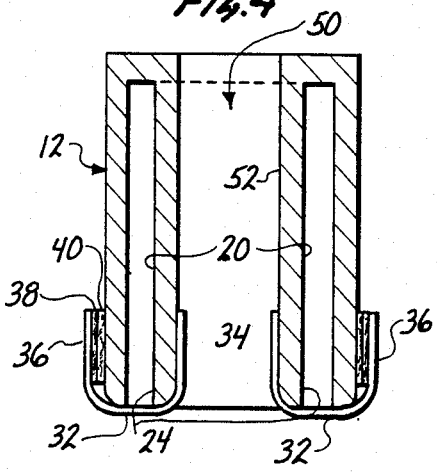
FIG. 4 is a longitudinal cross section of the carrier taken along line 4—4 in FIG. 2.

Two retainer straps 32 are provided for selectively closing the open end 24 of the hook receiving slot 20, as best understood by reference to FIG. 4. Each strap element 32 has one end 34 affixed to the carrier body 12 on an inner side of the slot opening 24 and is releasably engageable at its opposite end 36 to the carrier body 12 on an outer side of the slot 24. FIGS. 2 and 4 show the retainer straps 32 in their secured, closed positions, while FIGS. 1 and 3 show the strap elements 32 in open, disengaged condition allowing insertion or removal of hanger hooks into slot 20. The end 36 of each strap 32 is preferably provided with a first hook-or-loop type element 38 (of the type commercially available under the Velcro registered mark) engageable to a mating second hook-or-loop element 40 affixed to the carrier body as indicated in FIGS. 1, 3 and 4. When fastened in their closed position, each strap element 32 lies stretched across the slot opening 24 and around the end edges of the carrier body so as to prevent the hanger hooks from sliding along the internal slot surfaces and falling out of the carrier body through the slot opening 24 as the carrier body is tilted during transport. Two carrying loops 42 are provided, one loop connected to each end 22 of the carrier body at the intermediate upper portion 18 of the carrier body. Each loop 42 may consist of a length of suitable rope woven of either natural or synthetic fiber with the carrier body molded onto the rope so as to securely anchor the loop to the body, or may be a continuous strap of synthetic plastic, or any other relatively pliable material of sufficient strength for this purpose secured to the body by any suitable means.

FIGS. 2 and 3 show the manner in which a number of conventional garment hangers are suspended from and simultaneously carried by means of the novel carrier 10. FIG. 2 illustrates three garment hooks 44 inserted within the carrier slot 20, each hook supporting a typical wooden garment hanger 46. Each hook 44 lies in a plane transverse to the carrier axis at mutually axially spaced positions. The hooks are slideable within the slot 20 between the slot ends and the capacity of the carrier is determined only by the axial length of the carrier slot 20 and the thickness of the hooks received therein. The hooks 44 are inserted sequentially through the slot end opening 24 after the retainer straps 32 have been disengaged and moved away clear of the slot opening 24, as best seen in FIG. 3.

After the hooks 44 of all the garment hangers 46 have been inserted into the carrier slot 20, the hangers are secured within the carrier by closing the retainer straps 32 in the manner shown in FIG. 4, and the entire package may be lifted and carried by the two carrying straps or loops 42.

Figure 5:
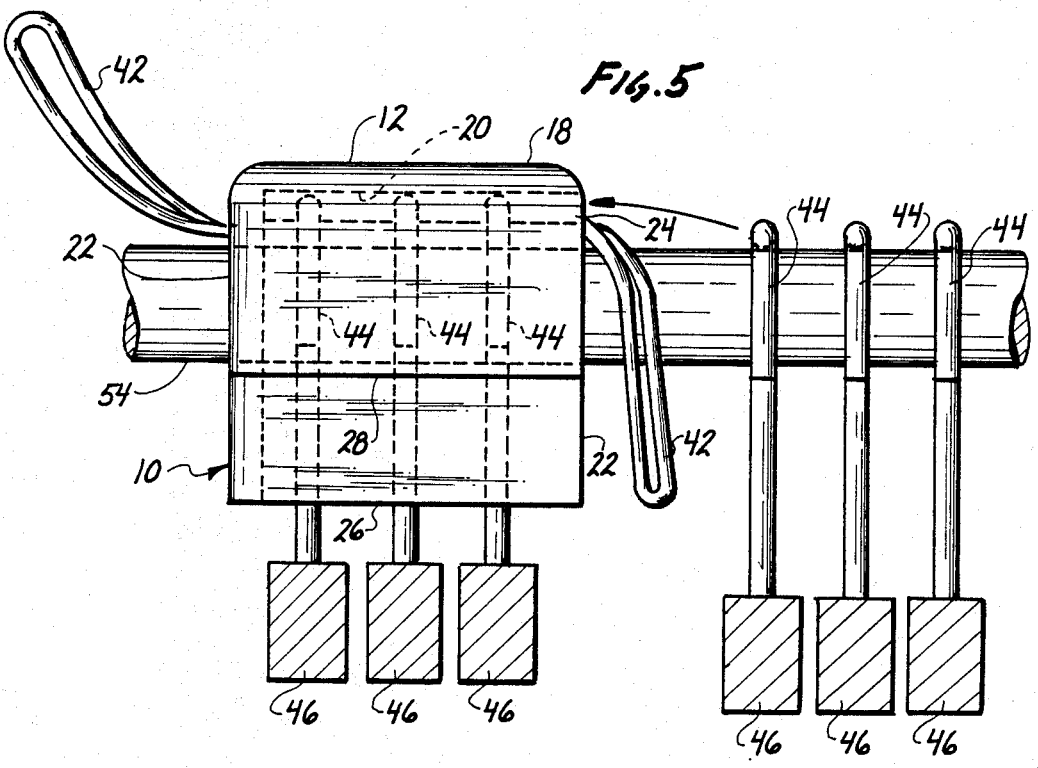
FIG. 5 illustrates the carrier seated on a typical hanger rod for facilitating loading or unloading of garments.

The carrier body 12 has a recess 50 extending longitudinally along the underside of the carrier body between the two ends 22 of the carrier body 12. The longitudinal recess 50 has an arcuate concave interior surface 52 best seen in the end view of FIG. 3 which remains substantially constant in cross section in a longitudinal direction as shown in FIG. 4. This longitudinal recess 50 is shaped and dimensioned to receive a hanger rod and thus allows the carrier body to be seated on a hanger rod 54 of the type found in household closets or the like in the manner shown in FIG. 5. Garments hung from the rod 54 by means of hangers 46 can be quickly loaded into the novel carrier 10 by first placing the carrier body 12 on the rod 54 so that the rod is received longitudinally within the recess 52 of the carrier. Hanger hooks 44 of garment hangers 46 are then moved longitudinally along the hanger rod and loaded into the open end 24 of the carrier slot 20, which requires only slight lifting and short longitudinal displacement of the hanger hooks 44. Once loaded with garment hangers 46 the carrier body 12 is lifted off the hanger rod 54 by means of the carryiing loops 42 together with the garments suspended therefrom. In a similar manner, the carrier 10 can be quickly and easily unloaded by seating the carrier body 12 on hanger rod 54 and sequentially sliding the hanger hooks 44 out of the slot 20 and onto the hanger rod. The carrier 10 seats in a stable manner on the hanger rod 54 at least so long as one or more garment hangers 46 serving as a counterweight remain loaded within the carrier 10.

Figure 6:
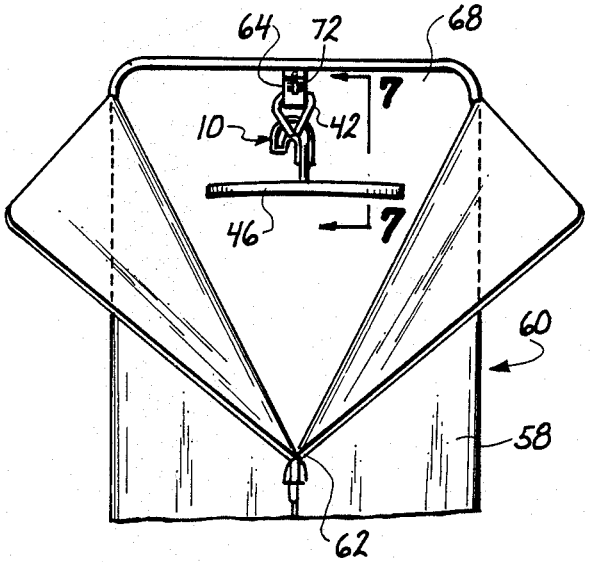
FIG. 6 is a partial fron view of a typical garment bag adapted for use with the carrier of this invention.

The carrier 10 is further useful in combination with a garment bag, garment carrier or similar luggage of the type constructed for transporting clothing suspended from hangers secured within the garment bag. A typical garment bag 60 illustrated in FIG. 6 is an elongated rectangular bag, only the upper end of which is shown, constructed of suitable pliable material. A front side 58 of the bag 60 is provided with a zipper fastener 62 extending between the opposite ends of the bag which allows the bag to be opened and closed, as suggested in FIG. 6. In conventional garment bags one or more hanger retainers are provided at one end of the garment bag for securing garment hangers to the bag. Presently available garment bags of this type generally use modified hangers specially adapted to cooperate with particular retaining fixtures anchored to the bag which serve to hold the hangers and garments in place.

Figure 7:
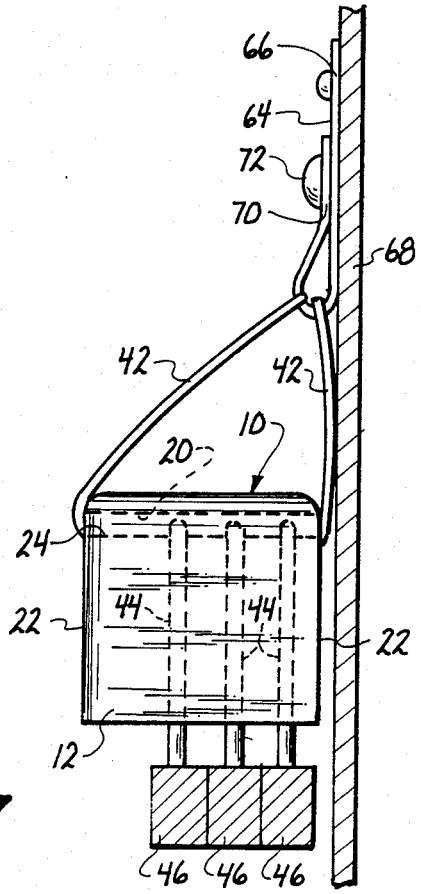
FIG. 7 is a cross-section taken in elevation along line 7—7 in FIG. 6.

The hanger carrier 10 of this invention may be used in place of the hanger retaining fixtures normally found in such garment bags, and can be used for securing and carrying unmodified, ordinary hangers in the garment bag so long as the hangers have hooks which can be inserted into the longitudinal slot 20 of the carrier 10. For this purpose, the garment bag 60 is provided with a suitable retainer such as a strap 64 anchored at one end 66 to the closed bottom wall 68 of the garment bag, and looped through both carrying straps 42 of the carrier 10. The free end 70 of the retainer strap is then secured to the wall 68 of the garment bag 60 by means of a suitable releasable fastener 72 such as a swivel head adapted to pass through a slot in the strap and securing the same upon being rotated transversely to the slot, thereby retaining the carrier 10 to the garment bag wall 68 as shown in FIG. 7. Clothing may then be suspended within the garment bag 60 from one or more garment hangers 46 held in the carrier 10 as shown in FIGS. 6 and 7. One significant advantage of this garment bag/-hanger carrier combination is the resultant ability to quickly load or unload the garment bag by removing the hanger carrier 10 from the garment bag 60 together with all clothing, placing the same on a hanger rod in a closet and loading or unloading it in the manner described in connection with FIG. 5, thereby greatly expediting packing and unpacking of garment bags when e.g., arriving or leaving a hotel. All hangers may be removed from the garment bag as a single bundle simply by releasing the retainer strap end 70 to free the carrier 10, then lifting the carrier from the bag with all garments suspended therefrom, carrying the carrier to a closet, and seating the carrier on the closet hanger rod for unloading as already described. Likewise, upon checking out of a hotel the garments may be quickly loaded onto the carrier 10 which is then returned with the garments to the garment bag and secured thereto by means of the retainer strap 64.

It must be understood that while a substantially rigid material such as plastic material is preferred for making the carrier body 12, a functionally equivalent carrier and carrier body construction may be achieved by using flexible materials, including textile materials cut and sewn to make a carrier body having the essential characteristics of the carrier body 12 described above.

It must be understood that many variations and modifications to the aforedescribed embodiment are possible without departing from the spirit and scope of the present invention. For example, the carrier slot 20 may extend fully longitudinally through the carrier body 12 and be open at both ends 22 of the carrier body instead of terminating in a blind end or closed bottom 30. In such alternate embodiment, closure or retainer straps 32 may be provided at each end 22 of the carrier body in a manner analogous to that already described. A further variation of the described embodiment may have only a single carrying strap 42 at one end 22 of the carrier body, or a single loop connected between and bridging the opposite carrier body ends 22. A still further variation may have a carrying handle of any suitable design molded integrally with the carrier body 12, such as at the upper end of the intermediate portion 18 in lieu of any carrying straps. Still further, the carrying straps 42 may be eliminated altogether without any particular carrying handle being provided in which case the carrier 10 can be seized under the short leg 14 for carrying. In the illustrated embodiment, the retainer straps 32 could also be eliminated if desired, since the carrying strap 42 at the open slot end does lie across the slot opening 24 when the carrier is suspended from the straps, thereby blocking the slot opening 24 and preventing actual loss of hanger hooks 44 from the slot 20. This latter solution is not quite as effective as providing a pair of closure straps 32 because the carrying strap 42 would only retain the outermost hook 44 against separation and loss from the carrier 10 but would not be fully effective in keeping the hook 44 within the slot 10. In other words, it would be possible for the hook 44 to slip out of the slot 20 but remain suspended from the strap 42 while the device is being carried by the strap.

From the foregoing, it will be apparent that while a particular, presently preferred embodiment of the invention has been illustrated and described for purposes of explanation and clarity, many variations, substitutions and modifications of the described embodiment will readily occur to those possessed of ordinary skill in the art, the invention being therefore defined and limited only by the scope of the following claims.

What is claimed is:

1. A carrier for garment hangers of the type having a hook for suspending the hanger from a horizontal rod or the like, said carrier comprising:

a carrier body having a longitudinal axis and at least one lower edge extending between the two carrier body ends; and a hanger receiving slot extending within said body along said axis, said slot having a substantially constant hook-shaped cross-section in a plane transverse to said longitudinal axis and being open at least at one of said body ends and along said lower edge said open lower edge communicating with said open end for laterally admitting and supporting a plurality of garment hanger hooks side by side along said axis such that the hangers associated with said hooks may be carried together suspended from said carrier body.

2. The carrier of claim 1 further comprising hook retainer means selectively engageable for preventing withdrawl of said garment hanger hooks from said slot.

3. The carrier of claim 2 wherein said retainer means comprise at least one element movable between a closed position wherein said least one element is secured across said open end of said slot and an open position wherein said at least one element is moved clear of said slot to allow hanger hooks to be removed from or inserted into said slot through said open end.

4. The carrier of claim 3 wherein said at least one element comprises a pliable retainer strap attached at one strap end to said body on one side of said open slot end and releasably securable at an opposite strap end to said body on another side of said open slot end whereby when so secured the strap extends across said open end for retaining garment hooks within said slot.

5. The carrier of claim 1 further comprising carrying handle means connected to said carrier body.

6. The carrier of claim 5 wherein said carrying handle means comprise at least one carrying strap connected to said body.

7. The carrier of claim 1 wherein said carrier body is a unitary molded plastic body.

8. A carrier for garment hangers of the type having a hook for suspending the hanger from a horizontal rod or the like, said carrier comprising:

a carrier body having a longitudinal axis extending between two carrier body ends and having a cross section shaped as an inverted U;

a hanger receiving slot extending within said body along said axis, said slot also having a substantially constant inverted U cross-section in a plane transverse to said longitudinal axis and being open at least at one of said body ends and along a lower edge of said carrier body, said open lower edge being parallel to said longitudinal axis and communicating with said open end, for laterally admitting and supporting a plurality of garment hanger hooks such that the hangers associated with said hooks may be carried side by side along said axis together suspended from said carrier body; and retainer means for releasably holding said garment hanger hooks against withdrawl from said slot.

9. The carrier of claim 8 further comprising carrying handle means connected to said carrier body.

10. The carrier of claim 9 wherein said handle means comprise at least one loop of flexible material.

11. The carrier of claim 9 wherein said handle means comprise a flexible carrying strap connected to each said carrier body end.

12. The carrier of claim 8 wherein said retainer means comprises at least one pliable retainer strap attached to one strap end to said body on one side of said open slot end and releasably securable at an opposite strap end to said body on another side of said open slot end whereby when so secured the strap extends across said open end for retaining garment hooks within said slot.

13. A carrier for garment hangers of the type having a hook for suspending the hanger from a horizontal rod or the like, said carrier comprising:

a unitary carrier body having a longitudinal axis extending between two carrier body ends and having a cross section shaped as an inverted U;

a hanger receiving slot extending within said body along said axis, said slot also having an inverted U shape in a plane transverse to said longitudinal axis and being open at least at one of said body ends for admitting a plurality of garment hanger hooks such that the hangers associated with said hooks may be carried together suspended from said carrier body;

a flexible carrying loop connected to each said carrier body end; and retainer means for releasably closing said open end of said slot thereby to prevent accidental withdrawl of said garment hanger hooks from said slot, said retainer means including at least one pliable retainer strap attached at one strap end to said body on one side of said open slot end and releasably securable at an opposite strap end to said body on another side of said open slot end whereby when so secured the strap extends across said open slot end for retaining garment hooks within said slot.

14. An improved garment carrier bag for transporting wearing apparel suspended from garment hangers of the type having a hanger hook, comprising:

a garment bag having two bag ends;

a hanger carrier comprising a carrier body having a longitudinal axis extending between two carrier body ends and a hanger receiving slot extending within said body along said axis, said slot being hook-shaped in a plane transverse to said longitudinal axis and being open at least at one of said body ends and along a lower edge of said body for admitting and supporting within said bag a plurality of garment hanger hooks such that the hangers associated with said hooks may be carried together suspended from said carrier body; and means for releasably securing said carrier to said garment bag at one end thereof whereby a plurality of hangers may be simultaneously removed from said bag by releasing said carrier body therefrom.

* * * * *